US005866886A

United States Patent [19]

Lange et al.

[11] Patent Number: 5,866,886

[45] Date of Patent: Feb. 2, 1999

[54] TRIANGULAR SHAPED AIR INLET FOR AN OVER-THE-RANGE TYPE OVEN

[75] Inventors: Scott Wayne Lange, Louisville, Ky.; Matthew Samuel Miller, St. Joseph, Mich.

[73] Assignee: General Electric Company, Louisville, Ky.

[21] Appl. No.: 835,687

[22] Filed: Apr. 10, 1997

[51] Int. Cl.[6] ..... H05B 6/80; F24C 15/20

[52] U.S. Cl. ..... 219/757; 219/681; 126/219 D; 126/21 A; 454/339

[58] Field of Search ..... 219/757, 400, 219/401, 685, 681; 126/299 D, 299 E, 21 A, 21 R; 454/237, 245, 254, 339

[56] References Cited

U.S. PATENT DOCUMENTS 3,818,171 6/1974 Miller et al. .
4,143,646 3/1979 Sampsel .
4,180,049 12/1979 Carr et al. .
4,327,274 4/1982 White et al. .
4,354,084 10/1982 Husslein et al. .
4,418,261 11/1983 Jailor et al. .
4,617,909 10/1986 Molitor .
4,763,638 8/1988 Hurley et al. .
4,944,285 7/1990 Glassman ..... 126/299 D
5,042,458 8/1991 Spencer et al. .
5,259,817 11/1993 Schumacher et al. ..... 454/296

*Primary Examiner*—Philip H. Leung
*Attorney, Agent, or Firm*—H. Neil Houser

[57] ABSTRACT

An over-the-range type oven incorporating a bottom plate having substantially triangular shaped openings, or inlets, is described. In one embodiment, the bottom plate has a first, interior surface and a second, range-facing surface. First and second triangular shaped openings, or inlets, extend through the bottom plate, and each triangular shaped opening has a first leg, a second leg and a third leg. The bottom plate may further include a first air guide positioned adjacent at least one of the first opening legs and extending from the bottom plate first, interior surface for directing air flow through the first opening and into the oven cabinet, and a second air guide positioned adjacent at least one of the second opening legs and extending from the bottom plate first, interior surface for directing air flow through the second opening and into the oven cabinet.

34 Claims, 2 Drawing Sheets

Fig. 1
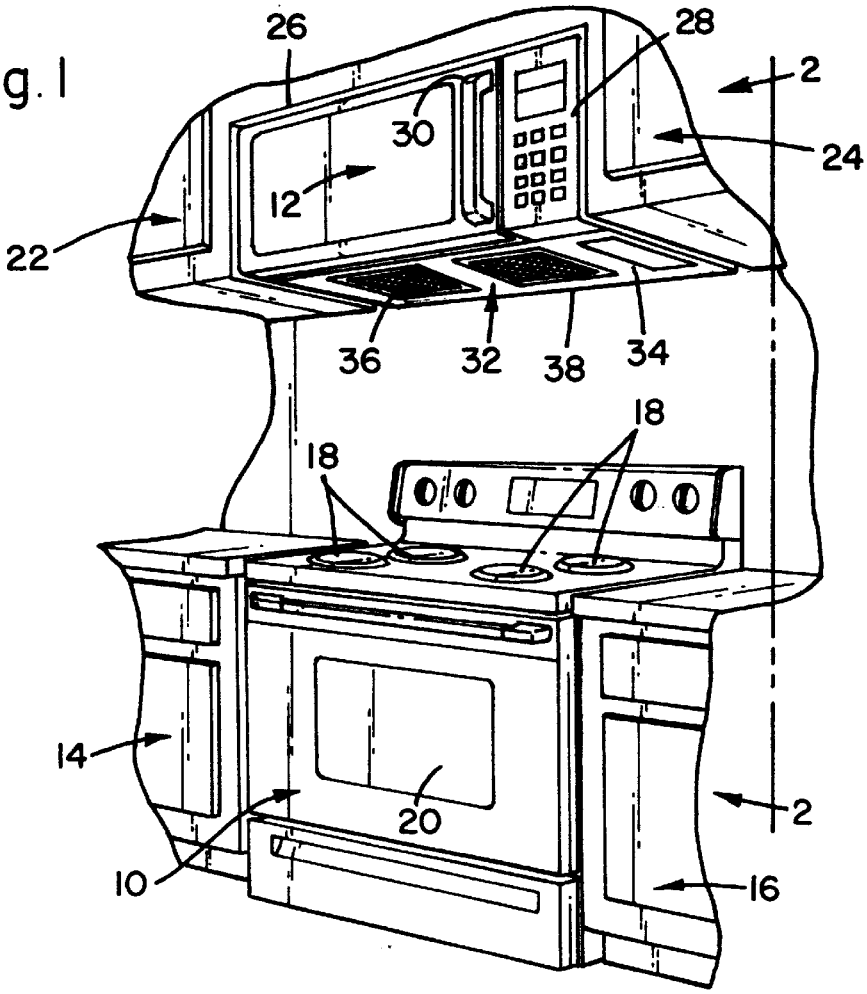
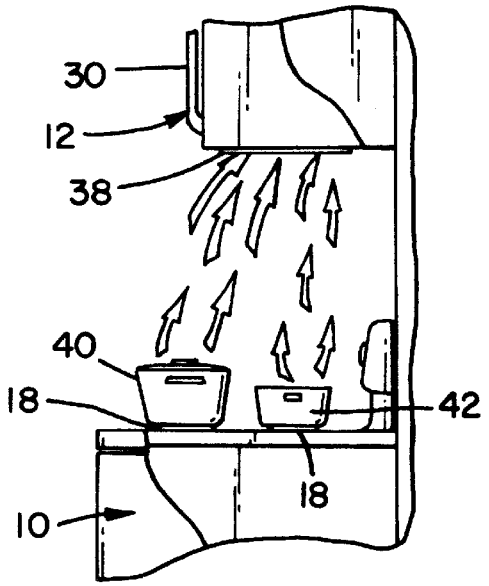
Fig. 2

SQUARE FILTER
(VELOCITY FT/MIN)

PROPOSED TRIANGULAR FILTER
(VELOCITY FT/MIN)

TRIANGULAR SHAPED AIR INLET FOR AN OVER-THE-RANGE TYPE OVEN

FIELD OF THE INVENTION

This invention relates generally to exhaust systems for cooking apparatus and, more particularly, to an exhaust system for an over-the-range type oven.

BACKGROUND OF THE INVENTION

Known cooking apparatus include an eye-level oven, e.g., an over-the-range microwave oven, mounted over a range. An over-the-range microwave oven typically includes an exhaust system for removal of gases and cooking fumes in the range burner vicinity. Known exhaust systems include filters located over square or rectangular shaped openings in a bottom plate of the oven. The bottom plate is spaced from the microwave oven cooking chamber lower wall, and the bottom plate and cooking chamber define a lower, substantially horizontal air channel. The oven cabinet side walls and the cooking chamber side walls define substantially vertical air channels, and the oven cabinet top wall and the cooking chamber top wall define an upper, substantially horizontal air channel in flow communication with an air outlet. A blower motor is located in the upper horizontal air channel, and the blower motor is in flow communication with all the above described air channels.

When the blower motor is energized, the blower draws air through the filters and bottom plate openings into the lower horizontal channel. The air is then drawn through the vertical air channels, and through the upper horizontal channel. Air drawn through the oven as described above is discharged from the oven through the air outlet.

The above described exhaust system removes gases and fumes over the range. Removal of such gases and fumes is important in that any gases and fumes that are not effectively removed through the exhaust system typically will dissipate throughout the entire room. Also, unremoved fumes tend to deposit grease and carbon on the bottom and front exterior walls of the over-the-range oven.

Although known exhaust systems are generally effective at removal of gases and fumes, it would be desirable to even further improve such gas and fume removal. It also would be desirable to provide such improved gas and fume removal without increasing the cost of the oven.

SUMMARY OF THE INVENTION

These and other objects may be attained in an over-the-range type oven incorporating a bottom plate having substantially triangular shaped openings or inlets. Fumes and gases over the range are drawn through the triangular shaped openings by the over-the-range oven exhaust system blower motor. The triangular shaped openings are believed to result in a more even distribution of air flow than known square or rectangular shaped openings, and such air flow distribution is believed to improve gas and fume removal.

More specifically, and in one embodiment, the over-the-range type oven includes a cabinet and a cooking chamber. The cooking chamber is located within the cabinet and is spaced from the cabinet walls. The cabinet side walls and cooking chamber side walls define air channels, as is known. The oven also includes an exhaust system blower motor for drawing air through the oven air channels and exhausting the air through an air outlet.

Further, the over-the-range oven includes a bottom plate having a first, interior surface and a second, range-facing surface. First and second triangular shaped openings, or inlets, in the bottom plate each have a first leg, a second leg and a third leg. The bottom plate may further include a first air guide positioned adjacent at least one of the first opening legs and extending from the first, interior surface for directing air flowing through the first opening and into the oven cabinet, and a second air guide positioned adjacent at least one of the second opening legs and extending from the first, interior surface for directing air flowing through the second opening and into the oven cabinet.

In operation, and when the air exhaust motor is operating, gases and fumes over the range are drawn into the cabinet through the filters and the triangular shaped openings in the bottom plate. The air is then directed through the air channels and is emitted from the cabinet at the air outlet.

As compared to known square or rectangular shaped openings in a bottom plate, the triangular shaped openings are believed to provide a significant advantage in that with the triangular shaped openings, it is believed that gases and fumes from the range are more effectively removed. Specifically, with a triangular shaped opening, a nearly even distribution of air flow is established across the opening. This result is achieved because the cross sectional area at the high velocity end of the opening is smaller and has increased resistance, thus forcing air to flow through the lower velocity areas of the opening where less flow resistance, i.e., a greater effective cross sectional area, is established.

By providing a more even distribution of air flow across the triangular shaped opening, it is believed that the removal of gases and fumes over the range is significantly enhanced. Further, and importantly, such improved gas and fume removal is provided without significantly increasing the cost of the exhaust system.

BRIEF DESCRIPTION OF THE DRAWINGS

FIG. 1 illustrates a range and an over-the-range type microwave oven in a typical, residential configuration.

FIG. 2 is a side view, through line 2—2 shown in FIG. 1, and illustrating gases and cooking fumes from the range being removed by the exhaust system of the over-the-range microwave oven.

DETAILED DESCRIPTION OF THE DRAWINGS

Figure 3:
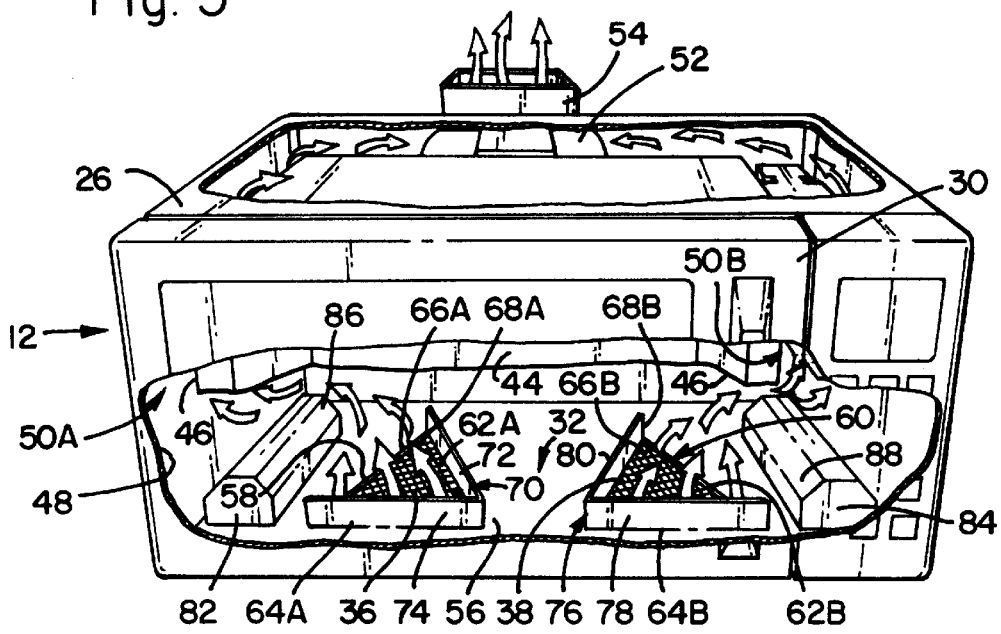
FIG. 3 is a front view, with parts cut away, of an over-the-range microwave oven incorporating a bottom plate in accordance with one embodiment of the present invention.
Figure 3:
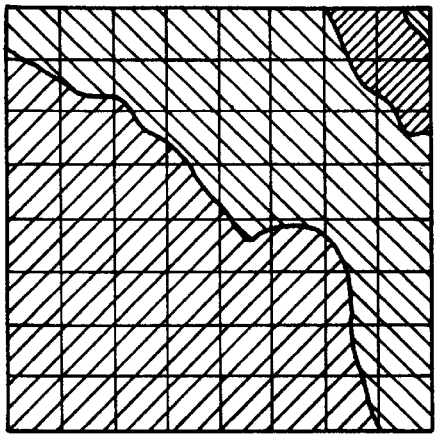

FIG. 1 illustrates a cooking range 10 and an over-the-range type microwave oven 12 in a typical, residential configuration. Cooking range 10 is positioned between cabinets 14 and 16, and includes burners 18 and a lower oven 20 beneath burners 18. Microwave oven 12 is located above burners 18 at a sufficient height to allow easy access to burners 18 but low enough to allow easy access to oven 12 and to allow efficient exhausting of gases and fumes emanating from food on burners 18. Oven 12 is positioned between eye-level cabinets 22 and 24, and oven 12 includes a cabinet 26, a control panel 28 and a door 30. Oven 12 further includes a bottom plate 32 having a range facing surface 34. Filters 36 and 38 are removably secured to bottom plate 32.

As shown in FIG. 2, which is a side view of range 10 and oven 12 through line 2—2 shown in FIG. 1, gases and cooking fumes from pots 40 and 42 containing food and cooking on burners 18 are drawn through filters 36 and 38 (only filter 38 is visible in FIG. 2) and into an exhaust system (not shown in FIG. 2) of oven 12. As explained above, removal of such gases and fumes is important in that any gases and fumes that are not effectively removed through the exhaust system typically will dissipate throughout the entire room. Also, unremoved fumes from pots tend to deposit grease and carbon on the bottom and front exterior walls of oven 12.

FIG. 3 is a front view, with parts cut away, of over-the-range microwave oven 12 incorporating bottom plate 32. As shown in FIG. 3, over-the-range oven 32 includes a cooking chamber 44 supported within cabinet 26. Cooking chamber sidewalls 46 are spaced from bottom plate 32 and cabinet sidewalls 48, and cabinet sidewalls 48, bottom plate 32, and cooking chamber sidewalls 46 define air channels 50. Oven 12 also includes an exhaust system motor 52 for drawing air through air channels 50 and for exhausting air through an air outlet 54.

Bottom plate 32 of oven 12 includes an interior surface 56 and range-facing surface 34 (FIG. 1). First and second triangular shaped openings 58 and 60, or inlets, extend through bottom plate 32, and triangular shaped openings 58 and 60 have a first leg 62A and 62B, a second leg 64A and 64B and a third leg 66A and 66B, respectively. Ends 68A and 68B of openings 58 and 60 are sometimes referred to as the high velocity ends of openings 58 and 60 because high velocity airflow tends to occur at ends 68A and 68B. As explained below in more detail, triangular shaped openings 58 and 60 are believed to provide a more even distribution of air flow than known square or rectangular shaped openings, and the more even distribution of air flow is believed to facilitate more effective removal of gases and fumes over range.

Bottom plate 32 further include a first air guide 70 positioned adjacent first and second legs 62A and 64A of first opening 58 and extending from interior surface 56 for directing air flowing through first opening 58 and into oven cabinet 26. Specifically, first air guide 70 includes a first flange 72 extending along a length of first opening first leg 62A, and a second flange 74 extending along a length of first opening second leg 64A. Air flow through first opening 58 as directed by first air guide 70 is illustrated in FIG. 3 by arrows.

Bottom plate 32 also includes a second air guide 76 positioned adjacent second and third legs 64B and 66B of second opening 60 and extending from interior surface 32 for directing air flowing through second opening 60 and into oven cabinet 26. Specifically, second air guide 76 includes a first flange 78 extending along a length of second opening second leg 64B, and a second flange 80 extending along a length of second opening third leg 66B. Air flow through second opening 60 as directed by second air guide 76 also is illustrated in FIG. 3 by arrows.

For further air flow control, bottom plate 32 includes a third air guide 82 positioned for directing air flowing from first opening 58 toward vertical air channel 50A, and a fourth air guide 84 for directing air flowing from second opening 60 toward vertical air channel 50B. Third and fourth air guides 82 and 84 each include an angular air directing surface 86 and 88, respectively, for directing air upward toward vertical air channels 50A and 50B, respectively.

In operation, and when air exhaust motor 52 is operating, gases and fumes over range 10 (FIG. 1) are drawn into cabinet 26 through filters 36 and 38 and through triangular shaped openings 58 and 60 in bottom plate 32. The air is then directed through air channels 50A and 50B, and is exhausted from cabinet 26 through air outlet 54. As described above, the particular configuration of triangular shaped openings 58 and 60, in conjunction with air guides 70, 76, 82 and 84, is believed to provide more effective removal of gases and fumes than with known over-the-range oven exhaust systems.

Figure 4A:
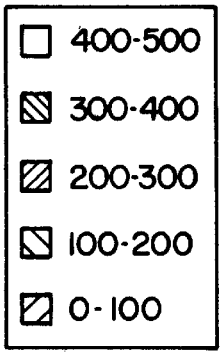
FIG. 4B is a chart depicting expected air flow velocities through a square shaped opening of an exhaust system in over-the-range oven.
Figure 4B:
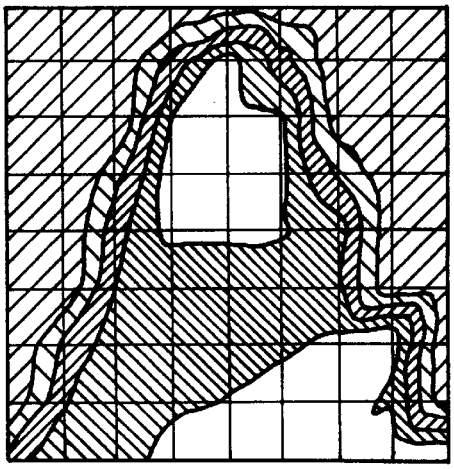

In this regard, FIGS. 4A and 4B are charts which depict expected air flow velocities through a square shaped opening of an exhaust system in an over-the-range oven (FIG. 4A) and depicting expected air flow through a triangular shaped opening of an exhaust system in an over-the range oven (FIG. 4B). A key is provided to indicate the velocity range associated with the areas shown in the respective charts.

With respect to air flow through a square shaped opening as graphically illustrated in FIG. 4A, it can be seen that high velocity air flow is substantially concentrated in a small area of the square shaped opening. That is, air flow velocity in the range of 300–400 ft./min. occupies a relatively small area of the chart as compared to other velocity ranges. This means that the high velocity air flow is directed through a small area of the square shaped opening and results in an uneven distribution of air flow across the opening.

In comparison, and with respect to air flowing through a triangular shaped opening as graphically illustrated in FIG. 4B, it can be seen that high velocity air flow is substantially increased and is distributed across the triangular shaped opening. That is, air flow velocity in the range of 400–500 ft./min. is not concentrated in just one area of the triangular shaped opening. Rather, such high velocity air flow is distributed across the triangular shaped opening.

This more even distribution of air flow established across the triangular shaped opening is achieved because the cross sectional area at the high velocity end of the triangular shaped opening is smaller and has increased air flow resistance. Therefore, air is forced to flow through the lower velocity areas of the opening having less flow resistance, i.e., a greater cross sectional area. This more even distribution of air flow across the triangular shaped opening is believed to provide more effective removal of gases and fumes over the range as compared to the gas and fume removal achieved with known square or rectangular shaped openings. Importantly, such improved gas and fume removal is provided without significantly increasing the cost of the oven.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A bottom plate for an over-the-range microwave oven, said bottom plate comprising:

a first, interior surface;

a second, range-facing surface;

a first triangular shaped opening comprising a first leg, a second leg and a third leg; and a first air guide positioned adjacent at least one of said first opening legs and extending from said first, interior surface for directing air flow through said first opening.

2. A bottom plate in accordance with claim 1 further comprising a filter removably secured to said second, range-facing surface and substantially covering said first opening.

3. A bottom plate in accordance with claim 1 wherein said first air guide comprises a first flange extending along a length of said first opening first leg, and a second flange extending along a length of said first opening second leg.

4. A bottom plate in accordance with claim 1 wherein the oven includes a cabinet and a cooking chamber, the cooking chamber being located within the cabinet, a cabinet side wall and a cooking chamber side wall defining a vertical air channel, and said bottom plate further comprises a second air guide for directing air flow from said first opening toward the first vertical air channel.

5. A bottom plate in accordance with claim 4 wherein said air guide comprises an angular air directing surface.

6. A bottom plate in accordance with claim 1 further comprising:

a second triangular shaped opening comprising a first leg, a second leg and a third leg; and a third air guide positioned adjacent at least one of said second opening legs and extending from said first, interior surface for directing air flow through said second opening.

7. A bottom plate in accordance with claim 6 further comprising a filter removable secured to said second, range-facing surface and substantially covering said second opening.

8. A bottom plate in accordance with claim 6 wherein said third air guide comprises a first flange extending along a length of said second opening second leg, and a second flange extending along a length of said second opening third leg.

9. A bottom plate in accordance with claim 8 wherein said fourth air guide comprises an angular air directing surface.

10. A bottom plate in accordance with claim 6 wherein the oven includes a cabinet and cooking chamber, the cooking chamber being located within the cabinet, a cabinet side wall and a cooking chamber side wall defining a vertical air channel, and said bottom plate further comprises a fourth air guide for directing air flow from said second opening toward the vertical air channel.

11. A bottom plate for an oven, said bottom plate comprising:

a first, interior surface;

a second, oven-facing surface;

a first triangular shaped opening comprising a first leg, a second leg and a third leg; and a second triangular shaped opening comprising a first leg, a second leg and a third leg.

12. A bottom plate in accordance with claim 11 further comprising:

a first air guide positioned adjacent at least one of said first opening legs and extending from said first, interior surface for directing air flow through said first opening; and a second air guide positioned adjacent at least one of said second opening legs and extending from said first, interior surface for directing air flow through said second opening.

13. A bottom plate in accordance with claim 12 wherein said first air guide comprises a first flange extending along a length of said first opening first leg, and a second flange extending along a length of said first opening second leg.

14. A bottom plate in accordance with claim 13 wherein said second air guide comprises a first flange extending along a length of said second opening second leg, and a second flange extending along a length of said second opening third leg.

15. A bottom plate in accordance with claim 11 wherein the oven includes a cabinet and a cooking chamber, the cooking chamber being located within the cabinet, cabinet side walls and cooking chamber side walls defining vertical air channels, and said bottom plate further comprises a third air guide for directing air flow from said first opening toward one of the horizontal air channels, and a fourth air guide for directing air flow from said second opening toward another one of the vertical air channels.

16. A bottom plate in accordance with claim 15 wherein said third air guide comprises an angular air directing surface, and said fourth air guide comprises an angular air directing surface.

17. A bottom plate for an over-the-range microwave oven, said bottom plate comprising:

a first, interior surface;

a second, range-facing surface;

a first triangular shaped opening; and a first air guide positioned adjacent said first triangular shaped opening.

18. A bottom plate in accordance with claim 17 wherein said first triangular shaped opening comprises a first leg, and said first air guide comprises a first flange adjacent said first leg.

19. A bottom plate in accordance with claim 18 wherein said first flange extends from said first, interior surface.

20. A bottom plate in accordance with claim 18 wherein said first triangular shaped opening further comprises a second leg and a third leg, and said first air guide further comprises a second flange adjacent said first opening second leg.

21. A bottom plate in accordance with claim 17 further comprising a filter removably secured to said second, range-facing surface and substantially covering said first opening.

22. A bottom plate in accordance with claim 17 further comprising a second triangular shaped opening and a second air guide positioned adjacent said second triangular shaped opening.

23. A bottom plate in accordance with claim 22 wherein said second triangular shaped opening comprises a first leg, and said second air guide comprises a first flange adjacent said second opening first leg.

24. A bottom plate in accordance with claim 23 wherein said second triangular shaped opening further comprises a second leg and a third leg, and said second air guide further comprises a second flange adjacent said second opening second leg.

25. A bottom plate in accordance with claim 23 wherein said first triangular shaped opening comprises a first leg, and said first air guide comprises a first flange adjacent said first leg.

26. A bottom plate in accordance with claim 22 further comprising a filter removably secured to said second, range-facing surface and substantially covering said second opening.

27. An exhaust system for an over-the-range type oven, the oven including a cabinet and a cooking chamber, the cooking chamber being located within the cabinet, cabinet side walls and cooking chamber side walls defining vertical air channels, said exhaust system comprising a bottom plate for being secured to the cabinet, said bottom plate comprising:

a first, interior surface;

a second, range-facing surface;

a first triangular shaped opening; and a first air guide positioned adjacent said first triangular shaped opening.

28. An exhaust system in accordance with claim 27 wherein said first triangular shaped opening comprises a first leg, and said first air guide comprises a first flange adjacent said first leg.

29. An exhaust system in accordance with claim 27 wherein said first triangular shaped opening further comprises a second leg and a third leg, and said first air guide further comprises a second flange adjacent said first opening second leg.

30. An exhaust system in accordance with claim 27 further comprising a filter removably secured to said second, range-facing surface and substantially covering said first opening.

31. An exhaust system in accordance with claim 27 further comprising a second triangular shaped opening and a second air guide positioned adjacent said second triangular shaped opening.

32. An exhaust system in accordance with claim 31 wherein said second triangular shaped opening comprises a first leg, and said second air guide comprises a first flange adjacent said second opening first leg.

33. An exhaust system in accordance with claim 32 wherein said second triangular shaped opening further comprises a second leg and a third leg, and said second air guide further comprises a second flange adjacent said second opening second leg.

34. An exhaust system in accordance with claim 33 wherein said first triangular shaped opening comprises a first leg, and said first air guide comprises a first flange adjacent said first leg.

* * * * *